US006119876A

United States Patent [19]

Lacourse

[11] Patent Number: 6,119,876

[45] Date of Patent: Sep. 19, 2000

[54] SUPPORT STRUCTURE FOR GERMINATION JARS

[76] Inventor: Jean-François Lacourse, 1753, Duvernay, Sherbrooke, Québec, Canada, J1H 5H1

[21] Appl. No.: 09/176,280

[22] Filed: Oct. 21, 1998

[51] Int. Cl.[7] ..... A47B 73/00; B65D 1/36

[52] U.S. Cl. ..... 211/74; 206/562

[58] Field of Search ..... 211/74, 75, 119.009, 211/135, 85.18; D6/524, 532, 574; 206/203, 564, 557, 562, 563, 446

[56] References Cited

U.S. PATENT DOCUMENTS

| | | | |
|---|---|---|---|
| D. 171,001 | 12/1953 | Mayer | D6/532 |
| D. 190,974 | 7/1961 | Salis | D6/524 |
| D. 277,295 | 1/1985 | Jones | D6/524 |
| D. 322,531 | 12/1991 | Hobson | D6/524 |
| D. 323,089 | 1/1992 | Koerbel | D6/574 |
| D. 338,793 | 8/1993 | Primeau | D6/524 |
| D. 400,384 | 11/1998 | Belokin et al. | D6/574 |
| 2,897,974 | 8/1959 | Cook | 211/74 |
| 3,860,048 | 1/1975 | White | 211/74 |
| 4,068,760 | 1/1978 | Johnson, Jr. | 211/74 |
| 4,132,311 | 1/1979 | Glinert | 206/564 |
| 4,681,219 | 7/1987 | Kitchens | 206/564 |
| 4,832,208 | 5/1989 | Finnegan | 211/74 |
| 4,928,841 | 5/1990 | Arthurs | 206/203 |
| 5,115,937 | 5/1992 | Chausse et al. | 206/203 |
| 5,379,905 | 1/1995 | Bustos et al. | 211/74 |
| 5,397,006 | 3/1995 | Terrell | 211/74 |
| 5,449,071 | 9/1995 | Levy | 206/564 |
| 5,503,858 | 4/1996 | Reskow | 206/564 |
| 5,641,061 | 6/1997 | De Muylder-Braun | 206/564 |

*Primary Examiner*—Daniel P. Stodola
*Assistant Examiner*—Jennifer E. Novosad

[57] ABSTRACT

A supporting structure for supporting germination jars in either an upright, an inverted or an angled position. The supporting structure also acts as a container for receiving and containing water dripping out of the germination jar. The supporting structure defines first and second abutment walls extending from a base wall. First and second abutment walls are configured, sized and positioned so as to abuttingly support the jar in an angled configuration relative to the base wall. The supporting structure also includes a third abutment wall adapted to cooperate with the first abutment wall for releasably securing the jar in either an upright or inverted configuration. A hooking lid extending peripherally from the structure allows the latter to be hooked to a conventional hook extending from a vertical wall. The structure may rest on a horizontal surface such as a table top. The structure is preferably made out of an integral piece of material.

2 Claims, 2 Drawing Sheets

SUPPORT STRUCTURE FOR GERMINATION JARS

FIELD OF THE INVENTION

The present invention relates to the field of horticultural articles and is particularly concerned with a support structure for germination jars.

BACKGROUND OF THE INVENTION

Increasing awareness about the potential hazards associated with commercial fertilizers, pesticides and the like used in the growing of food products has led to a concomitant increase in the number of individuals interested in domestically growing bean sprouts. The domestic growing of sprouts also ensures that the food product is fresh. Furthermore, home growing of food products provides an economical advantage over buying commercially grown articles. Also, the mere process of growing domestic products may provide for an enjoyable leisure activity.

Mung beans and alfalfa seeds are examples of food products that can be easily sprouted in a domestic setting. Heretofore, in growing bean sprouts, it has been a practice to grow them in a so called mason type jar. Such mason types jars have a generally cylindrical wall extending from a base wall. The cylindrical wall extends into a neck portion which, in turn, extends into an externally threaded mouth. A screen is threadably or otherwise mounted on the mouth.

Typically, sprouting of the beans or seeds involves positioning the latter within the jar and wetting them with a suitable liquid such as water for a predetermined period of time. Part of the water adheres to the beans or seeds and slowly trickles down to the lowest part of the sprouter forming a pool. Beans immersed in this pool will not sprout. In order to remove the pool the jar must be placed in an inverted position allowing the water to flow out of the jar through the screen while the latter retains the beans or seeds. The germination jar is then preferably positioned with its longitudinal axis at an angle typically substantially in the range of 45° relative to the vertical so as to allow for further dripping of the water as well as the proper air circulation so as to optimize the germination process.

In order to bring about the ability of the sprouter to be placed anywhere in the home without wetting the item it touches a so called drip catcher is typically used in combination with the jar for collecting drippings. The catcher typically consist of an opened top receptacle. Prior art drip catchers suffer from a set of drawbacks. Indeed, some of these prior art structures are not specifically adapted to the geometry of the germination jars and thus the latter are subject to slipping off from the drip catchers leading to the destruction of the container and wastage of the seeds being germinated. Also, some of the prior art drip catchers are not adapted to support the germination jars in an angled configuration relative to the vertical orientation. The germination containers are thus only supported in their inverted configuration during the germination process. In such an inverted position the drippings are not allowed to escape freely from the screen because of the formation of the puddle that seals the rim of the germination container and prevents the entry of air to replace the water that would desirably flow from the container. Still further, some of the prior art drip catchers are not provided with a structure allowing the drop catcher to be readily mounted to frames or vertical structures so as to allow stacking of such drip catchers and their associated jars. Consequently, the drip catchers and their associated jars occupy valuable horizontal supporting surfaces such as table tops.

Accordingly, there exists a need for an improved supporting structure for germination jars.

Advantages of the present invention include the fact that the proposed supporting structure is specifically configured to as to support conventional germination jars and are thus adapted to prevent the latter from slipping or otherwise falling off potentially causing destruction of the container and wastage of the seeds being germinated.

Also, the proposed supporting structure is specifically configured so as to allow for the germination jars to be supported in both an inverted and angled configuration so as to allow for optimization of the germination process. Furthermore, the proposed structure is adapted to provide a dripping chamber for containing liquid dripping of the germination jars. Still further, the proposed structure is specifically configured so as to be easily hooked to a suitable hooking structure which can be readily attached to a vertical frame or surface. The proposed structure is thus adapted to free valuable horizontal surfaces such as table tops, counter tops or the like.

Still further, the proposed structure is specifically configured so as to be manufactured as an integral structure so as to eliminate the need for assembly during its manufacturing process thus reducing the overall manufacturing cost. The integral configuration is specifically configured so as to be manufacturable through a relatively inexpensive manufacturing process such as thermofing, injection molding or the like.

In accordance with an embodiment of the invention there is provided a supporting structure for supporting a jar, the jar having a jar base wall, a jar peripheral wall and defining a jar longitudinal axis, the supporting structure being adapted to be selectively hooked to a hooking protruberance extending from a vertical support surface and abuttingly rested on a horizontal supporting surface, the supporting structure comprising: a base wall, the base wall defining a base wall inner surface and a base wall outer surface; a pair of opposed side walls extending upwardly from the base wall, each of the side walls defining a side wall inner surface, a side wall outer surface, a side wall lower peripheral edge and a side wall upper peripheral edge; a first abutment wall extending substantially upwardly from the base wall, the first abutment wall defining a first abutment wall inner surface, a first abutment wall outer surface, a first abutment wall lower peripheral edge and a first abutment wall upper peripheral edge; a second abutment wall connected to the base wall and positioned opposite the first abutment wall, the second abutment wall defining a second abutment wall inner surface, a second abutment wall outer surface, a second abutment wall upper peripheral edge and a second abutment wall lower peripheral edge; a third abutment extending from the base wall intermediate the first and second abutment walls in a generally parallel relationship relative to the latter, the third abutment wall defining a third abutment wall inner surface, a third abutment wall outer surface, a third abutment wall upper peripheral edge and a third abutment wall lower peripheral edge; the third abutment wall upper peripheral edge being positioned closer to the base wall and then the second abutment wall peripheral edge; the first and second abutment walls being configured, sized and positioned relative to each other so as to cooperate for abuttingly supporting the jar in a jar first position wherein the jar longitudinal axis is in a generally angled relationship relative to the base wall, the second and third abutment walls being configured, sized and positioned relative to each other so as to cooperate for abuttingly supporting the jar in a jar second position wherein the jar longitudinal axis is in a generally perpendicular relationship relative to the base wall.

Preferably, the second abutment wall upper peripheral edge is provided with at least one second wall recess formed therein for abuttingly mating with the jar peripheral wall. Conveniently, the second wall recess has a generally arcuate configuration.

Preferably, the third abutment wall is provided with at least one third wall recess formed therein for abuttingly mating with the jar peripheral wall. Conveniently, the third wall recess has a generally arcuate configuration.

Conveniently, the structure further includes a spacing wall extending between the second abutment wall lower peripheral edge and the third abutment wall upper peripheral edge. Preferably, the spacing wall extend in generally parallel relationship relative to the base wall.

Preferably, the structure further includes a hooking means for allowing the supporting structure to be hooked to the hooking protuberance extending from the vertical supporting surface. Conveniently, the hooking means includes a hooking section, the hooking section defining a hook first spacing segment extending generally outwardly from the first abutment wall peripheral edge; a hook first abutment segment extending downwardly from the hook first spacing segment in a spaced and generally parallel relationship relative to the first abutment wall so as to define a first hook spacing therebetween, the hook first abutment segment defining a first distal edge.

Conveniently, the structure further includes a pair of second side spacing segments extending generally outwardly from the second abutment wall upper peripheral edge and the side wall upper peripheral edges respectively; a hook second abutment segment and a pair of hook side abutment segments extending respectively downwardly from the hook second spacing segments and the hook side spacing segments in a spaced and generally parallel relationship relative respectively to the second abutment wall and the side walls so as to respectively define a second hook spacing and a pair of side hooks spacings therebetween, the hook second abutment segments and the hook side abutment segments defining respectively a hook second distal edge and a pair of hook side distal edges.

Preferably, the first, second and side distal edges are positioned in a common geometrical plane so as to define a resting edge for resting the supporting structure on the horizontal supporting surface. Conveniently, the structure is formed integrally out of a unitary piece of material.

Preferably, the second abutment wall defines a plurality of second wall recesses each abutment recess being configured for abuttingly mating with the jar peripheral wall and the third abutment wall is provided with a plurality of third wall recesses, each of the third wall recesses being configured for abuttingly mating with the jar peripheral wall.

In accordance with the present invention there is also provided a supporting structure for supporting a jar having a jar base wall, a jar peripheral wall and defining a jar longitudinal axis, the supporting structure being adapted to be hooked to a hooking protuberance extending from a vertical supporting surface, the jar being adapted to contain a liquid, the supporting structure comprising: a base wall having a base wall peripheral edge; a peripheral wall extending from the base wall peripheral edge; the base wall and the peripheral wall together defining an open top recess for receiving the liquid pouring out of the jar; the peripheral wall integrally defining an abutment means for selectively supporting the jar in a first and a second jar position wherein the jar longitudinal axis respectively extends perpendicularly and at an angle relative to the base wall.

Preferably, the structure further comprises a releasable anchoring means for releasably anchoring the supporting structure to the hooking protuberance.

BRIEF DESCRIPTION OF THE DRAWINGS

An embodiment of the present invention will now be described, by way of example, in reference to the following drawings in which.

DETAILED DESCRIPTION OF THE DRAWINGS

Figure 1:
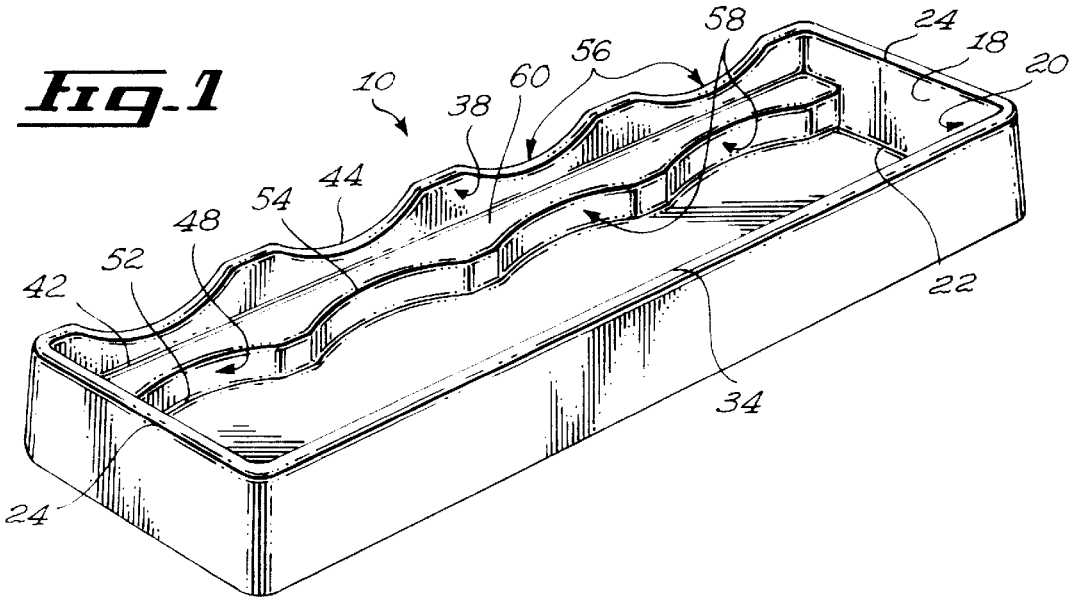
FIG. 1, in a perspective view, illustrates the supporting structure for germination jars in accordance with an embodiment of the present invention.
Figure 3:
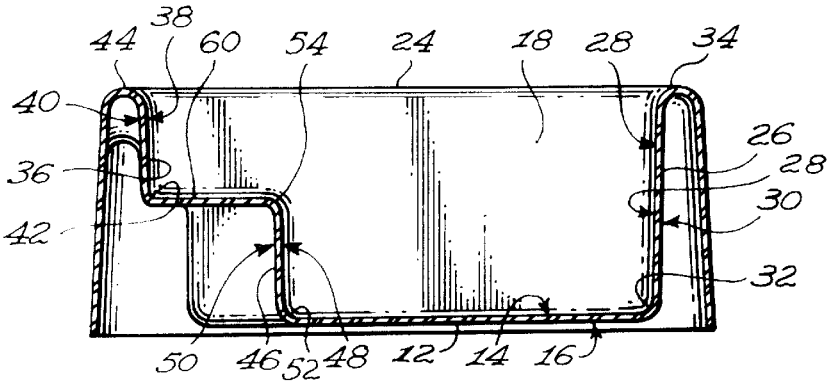
FIG. 3, in a transversal cross sectional view taken along arrows 33 of FIG. 2, illustrates part of the supporting structure shown in FIG. 1.

Referring to FIG. 1, there is shown in a perspective view a supporting structure 10 in accordance with an embodiment of the present invention. The supporting structure 10 has a generally flat base wall 12. As shown in FIG. 3, the base wall 12 defines a base wall inner surface 14 and an opposed base wall outer surface 16.

A pair of opposed side walls 18 extend upwardly and substantially perpendicularly from the base wall 12. Each of the side walls 18 defines a corresponding side walls inner surface 20, a side wall outer surface (not shown), a side all lower peripheral edge 22 and a side wall upper peripheral edge 24.

The support structure 10 also includes a first abutment wall 26 extending upwardly and substantially perpendicularly from the base wall 12. The first abutment wall 26 defines a first abutment wall inner surface 28, a first abutment wall outer surface 30, a first abutment wall lower peripheral edge 32 and a first abutment wall upper peripheral edge 34.

The support structure 10 further includes a second abutment wall 36 positioned opposite from the first abutment wall 26. The second abutment wall 36, in turn, defines a second abutment wall inner surface 38, a second abutment wall outer surface 40, a second abutment wall lower peripheral edge 42 and a second abutment wall upper peripheral edge 44.

The supporting structure 10 still further includes a third abutment wall 46. The third abutment wall 46 extends from the base wall 12 intermediate the first and second abutment walls 26, 36 in generally parallel relationship relative to the latter. The third abutment wall defines a third abutment wall inner surface 48, a third abutment wall outer surface 50, a third abutment wall lower peripheral edge 52 and a third abutment wall upper peripheral edge 54. The third abutment wall upper peripheral edge 54 is positioned lower to the base wall 12 than the second abutment wall upper peripheral edge 44 for reasons which will be hereinafter disclosed.

The second abutment wall upper peripheral edge 44 is provided with at least one second wall recess 56. The second wall recess 56 preferably has a generally arcuate configuration. Similarly, the third abutment wall 46 is provided with at least one third wall recess 58 formed therein. The third wall recess 58 preferably has a generally arcuate configuration.

The supporting structure 10 preferably further includes a spacing wall 60 standing between the second abutment wall lower peripheral edge 42 and the third abutment wall upper peripheral edge 54. Preferably the spacing wall 60 extends in a generally parallel relationship relative to the base wall 12.

The hooking structure 10 also preferably further includes a hooking means for allowing the support structure 10 to be hooked to a hooking protuberance such as a wall hook or frame hook 62 extending from a frame, a wall or any other suitable vertical supporting surface 64. The hooking means preferably takes the form of a hooking section 66. The hooking section 66 defines a hook first spacing segment 68 extending generally outwardly from the first abutment wall upper peripheral edge 34. The hooking section 66 further includes a hook first abutment segment 70 extending downwardly from the hook first spacing segment 68 in a spaced and generally parallel relationship relative to the first abutment wall 26 so as to define a first hook spacing 72 therebetween. The first hook spacing 72 is configured and sized for substantially fittingly receiving the hooking protuberance 62. The hook first abutment segment 70 defines a hook first distal edge 74.

The hooking section preferably further includes a hook second spacing segment 76 and a pair of hook side spacing segments (not shown) extending respectively generally outwardly from the second abutment wall and side walls upper peripheral edges. Similarly, a hooked second abutment segment 78 and a pair of hook side abutment segments (not shown) extend downwardly respectively from the hook first and side spacing segments in a spaced and generally parallel relationship relative to the second abutment wall 36 and the side walls 18 so as to define a second hook spacing 80 and side hook spacing (not shown) therebetween. The second and side hook abutment segments defined and respectively the second and side distal edges 82, 84. The first, second and side distal edges 74, 82 and 84 are preferably positioned underneath the base wall 12 so as to define a common resting edge for abuttingly supporting the supporting structure 10 when the latter is rested on a horizontal supporting surface such as a table top 86 shown in FIG. 5.

Figure 4:
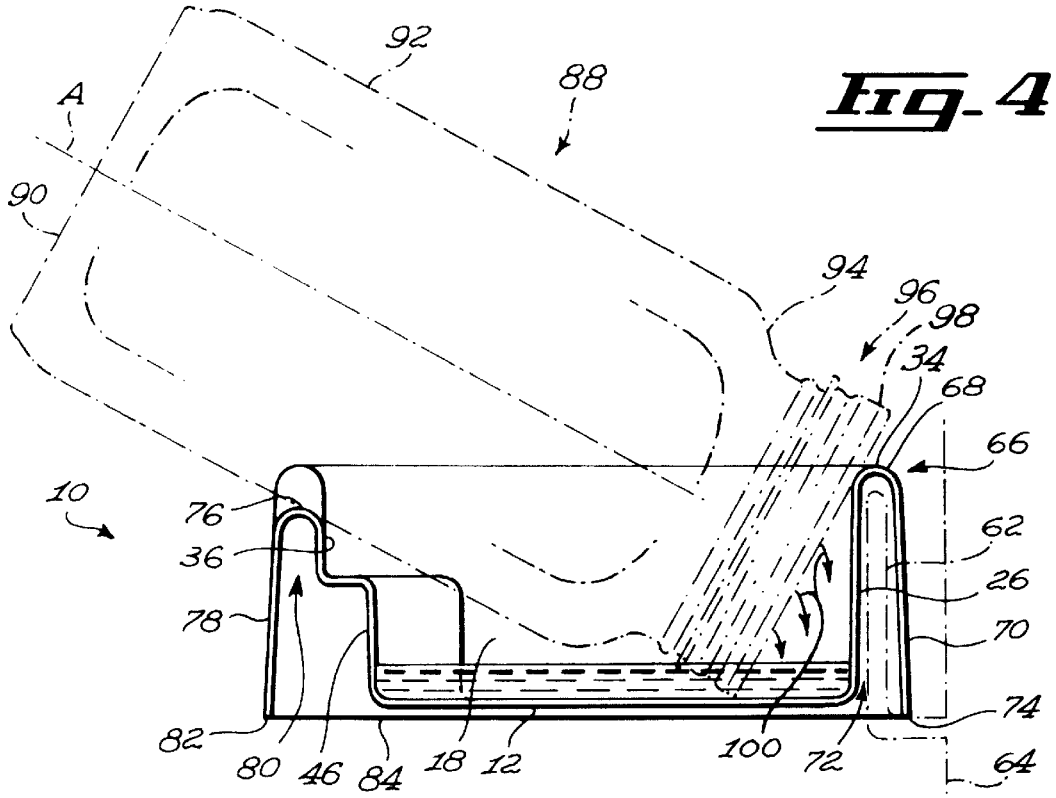
FIG. 4, in a cross sectional view taken along arrows 44 of FIG. 2, illustrates the configuration of the supporting structure shown in FIG. 1, a conventional germination jar being shown in phantom lines supported by the supporting structure in an angled configuration.
Figure 5:
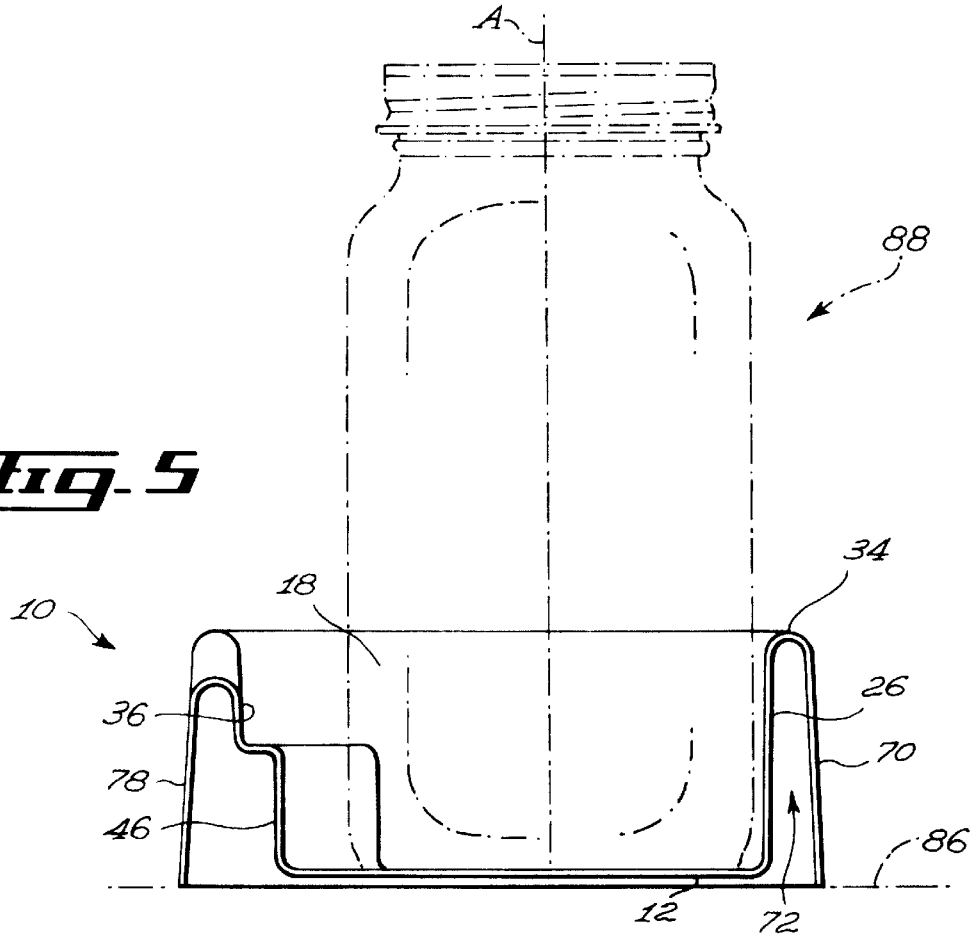
FIG. 5, in a cross sectional view taken along arrows 44 of FIG. 2, illustrates the configuration of the supporting structure shown in FIG. 1, a conventional germination jar being shown in phantom lines supported by the supporting structure in an inverted configuration.

Referring now more specifically to FIGS. 4 and 5, there is shown the supporting structure 10 supporting a conventional germination jar 88 respectively in a jar second and first position. The germination jar shown in FIGS. 4 and 5 is of the conventional mason type defining a jar bottom wall 90, a jar peripheral wall 92, a jar neck 94 and a jar pouring spout 96 provided with a perforated jar lid 98 mounted thereon. It should be understood that although a mason type jar is shown in FIGS. 4 and 5, the supporting structure 10 could be used with other types of jars without departing from the scope of the present invention. The jar 88 defines a jar longitudinal axis A extending between the jar base wall 90 and the jar pouring apertures (not shown) formed in the jar lid 98. FIG. 4, illustrates a situation wherein the supporting structure 10 is used for supporting the jar 88 in a substantially upright configuration with the jar base wall 90 abuttingly contacting the base wall 12 of the supporting structure 10 and the jar longitudinal axis A in a generally perpendicular relationship relative to the base wall 12. It should be understood that the jar 88 could also be supported in a similar manner in an inverted configuration with its longitudinal axis A in a perpendicular relationship relative to the base wall 12 and its lid 98 contacting the base wall 12. The first and third abutment walls 26 and 46 are configured, sized and positioned relative to each other so as to cooperate for relatively fittingly at least partially encircling a portion of a jar peripheral wall 92. Preferably, the jar peripheral wall 92 abuttingly contacts and frictionally engages both the first abutment wall inner surface 28 and the third abutment wall inner surface 48. In this manner, the jar 88 is secured in its upright or inverted configuration without the risk of slipping off or otherwise falling out of the supporting structure 10 even when the latter is moved from one location to another.

FIG. 4, illustrates the supporting structure 10 supporting the jar 88 in a jar second position wherein a jar longitudinal axis A is in an angled relationship relative to the base wall 12. The first and second abutment walls 26, 36 are configured, sized and positioned relative to each other so as to cooperate for abuttingly supporting the germination jar 88 in the jar second position. In the jar second position, a portion of the jar peripheral wall 92 abuttingly contacts the outer surface of a second wall recess 56 while the lid contacts both the base wall 12 and the upper peripheral edge 34 of the first abutment wall 26. Preferably, the second wall recess 56 is given a configuration substantially similar to that of the outer surface of the jar peripheral wall 92.

FIG. 4 further shows that the base wall 12, the first abutment wall 26, the third abutment wall 46 and the side walls 18 are adapted to cooperate for forming an open top container adapted to receive the maintain liquid 100 pouring out of the germination jar 88 through its perforated lid 98.

Figure 2:
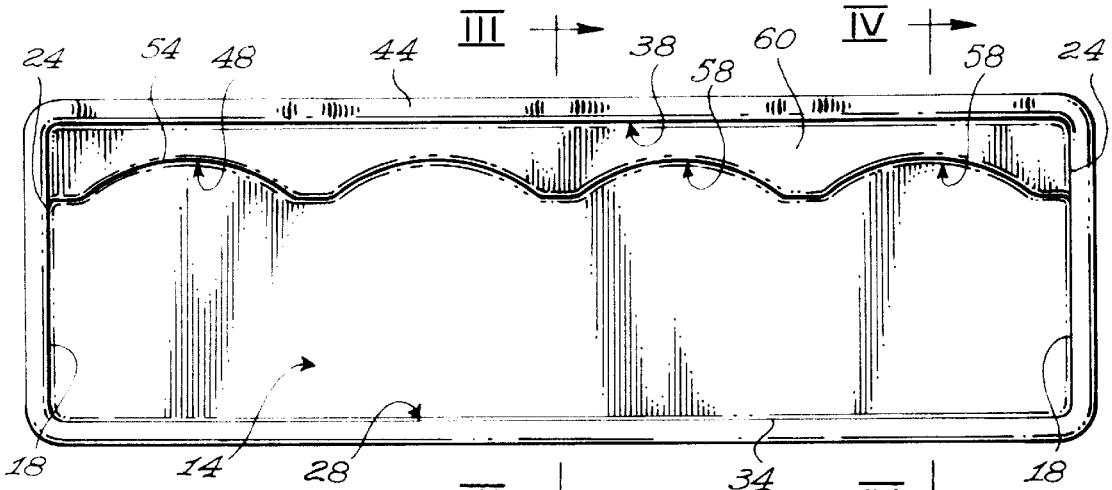
FIG. 2, in a top view, illustrates the supporting structure shown in FIG. 1.

As illustrated more specifically in FIGS. 1 and 2, in a preferred embodiment of the invention the supporting structure 10 is provided with second and third abutment walls 36, 46 respectively defining a plurality of adjacent second and third wall recesses 56, 58 for supporting a plurality of jars 88 in adjacent relationship relative to each others. Also, the first and second abutment walls 26 and 36 are preferably configured, sized and positioned relative to each other so that when the jar 88 is in the jar second position illustrated in FIG. 4, the longitudinal axis A forms an angle substantially in the range of 45° relative to the base wall 12.

The supporting structure 10 is specifically configured so as to be manufacturable out of a suitable material such as a polymeric resin using relatively inexpensive forms of manufacturing such as thermofing or injection molding. Furthermore, the supporting structure 10 is specifically configured so as to be manufacturable using an integral piece of unitary material.

What is claimed is:

1. A supporting structure for supporting a jar, said jar having a jar base wall, an opposed perforated jar top wall, a jar peripheral wall and defining a jar longitudinal axis, said supporting structure being adapted to be selectively hooked to a hooking protruberance extending from a vertical support surface and abuttingly rested on a horizontal supporting surface, said supporting structure comprising:

a base wall, sad base wall defining a base wall inner surface and a base wall outer surface;

a pair of opposed side walls extending upwardly from said base wall, each of said side walls defining a side wall inner surface, a side wall outer surface, a side wall lower peripheral edge and a side wall upper peripheral edge;

a first abutment wall extending substantially upwardly from said base wall, said first abutment wall defining a first abutment wall inner surface, a first abutment wall outer surface, a first abutment wall lower peripheral edge and a first abutment wall upper peripheral edge;

a second abutment wall positioned opposite said first abutment wall, said second abutment wall defining a second abutment wall inner surface, a second abutment wall outer surface, a second abutment wall upper peripheral edge and a second abutment wall lower peripheral edge; said second abutment wall upper peripheral edge being provided with at least one generally arcuate second abutment wall recess formed therein for abuttingly mating with said jar peripheral wall;

a third abutment wall extending from said base wall intermediate said first and second abutment walls in a generally parallel relationship relative to said second abutment wall, said third abutment wall defining a third abutment wall inner surface, a third abutment wall outer surface, a third abutment wall upper peripheral edge and a third abutment wall lower peripheral edge;

said third abutment wall upper peripheral edge being positioned closer to said base wall than said second abutment wall upper peripheral edge; said third abutment wall being provided with at least one generally arcuate third abutment wall recess formed therein for abuttingly mating with said jar peripheral wall;

a spacing wall extending between said second abutment wall lower peripheral edge and said third abutment wall upper peripheral edge, said spacing wall extending in generally parallel relationship relative to said base wall, said at least one generally arcuate second abutment wall recess positioned adjacent and above said spacing wall and said at least one generally arcuate third abutment wall recess positioned adjacent and below said spacing wall, whereby said at least one generally arcuate third abutment wall recess extends from said third abutment wall upper peripheral edge to said third abutment wall lower peripheral edge;

a hooking segment extending downwardly from said second and third abutment wall upper peripheral edges and from said side wall upper peripheral edges, said hooking segment extending outwardly and integrally from said second and third abutment wall upper peripheral edges and from said side wall upper peripheral edges; and a hook abutment segment extending perpendicularly and integrally from said hook spacing segment;

said first and second abutment walls being configured, sized and positioned relative to each other so as to be able to abuttingly support said jar in a jar first position wherein said jar longitudinal axis is in a generally angled relationship relative to said base wall with said jar top wall abuttingly contacting said first abutment wall, said jar peripheral wall may abuttingly contact said at least one generally arcuate second abutment wall recess and being spaced from said at least one generally arcuate third abutment wall recess;

said first and third abutment walls being configured, sized and positioned relative to each other so as to be able to abuttingly support said jar in a jar second position wherein said jar longitudinal axis is in a generally perpendicular relationship relative to said base wall with said jar base wall being capable of abuttingly contacting said base wall and said jar peripheral wall being capable of abuttingly contacting said at least one generally arcuate third abutment wall recess, and wherein said supporting structure being made out of an integral piece of material.

2. In combination, a supporting structure and a jar, said jar having a jar base wall, an opposed perforated jar top wall, a jar peripheral wall and defining a jar longitudinal axis, said supporting structure being adapted to be selectively hooked to a hooking protuberance extending from a vertical support surface and abuttingly resting on a horizontal supporting surface, said supporting structure comprising:

a base wall, said base wall defining a base wall inner surface and a base wall outer surface;

a pair of opposed side walls extending upwardly from said base wall, each of said side walls defining a side wall inner surface, a side wall outer surface, a side wall lower peripheral edge and a side wall upper peripheral edge;

a first abutment wall extending substantially upwardly from said base wall, said first abutment wall defining a first abutment wall inner surface, a first abutment wall outer surface, a first abutment wall lower peripheral edge and a first abutment wall upper peripheral edge;

a second abutment wall positioned opposite said first abutment wall, said second abutment wall defining a second abutment wall inner surface, a second abutment wall outer surface, a second abutment wall upper peripheral edge and a second abutment wall lower peripheral edge; said second abutment wall upper peripheral edge being provided with at least one generally arcuate second abutment wall recess formed therein which abuttingly mates with said jar peripheral wall;

a third abutment wall extending from said base wall intermediate said first and second abutment walls in a generally parallel relationship relative to said second abutment wall, said third abutment wall defining a third abutment wall inner surface, a third abutment wall outer surface, a third abutment wall upper peripheral edge and a third abutment wall lower peripheral edge;

said third abutment wall peripheral edge being positioned closer to said base wall than said second abutment wall upper peripheral edge; said third abutment wall being provided with at least one generally arcuate third abutment wall recess formed therein which abuttingly mates with said jar peripheral wall;

a spacing wall extending between said second abutment wall lower peripheral edge and said third abutment wall upper peripheral edge, said spacing wall extending in generally parallel relationship relative to said base wall said at least one generally arcuate second abutment wall recess positioned adjacent and above said spacing wall and said at least one generally arcuate third abutment wall recess positioned adjacent and below said spacing wall, whereby said at least one generally arcuate third abutment wall recess extends from said third abutment wall upper peripheral edge to said third abutment wall lower peripheral edge;

a hooking segment extending downwardly from said second and third abutment wall upper peripheral edges and from said side wall upper peripheral edges, said hooking segment defining a hook spacing segment extending outwardly and integrally from said second and third abutment wall upper peripheral edges and from said side wall upper peripheral edges; and a hook abutment segment extending perpendicularly and integrally from said hook spacing segment;

said first and second abutment walls being configured, sized and positioned relative to each other so as to cooperate in abuttingly supporting said jar in a jar first position wherein said jar longitudinal axis is in a generally angled relationship relative to said base wall with said jar top wall abuttingly contacting said first abutment wall, said jar peripheral wall abuttingly contacting said at least one generally arcuate second abutment wall recess and being spaced from said at least one generally arcuate third abutment wall recess;

said first and third abutment walls being configured, sized and positioned relative to each other so as to cooperate in abuttingly supporting said jar in a jar second position wherein said jar longitudinal axis is in a generally perpendicular relationship relative to said base wall with said jar base abuttingly contacting said base wall and said jar peripheral wall abuttingly contacting said at least one generally arcuate third abutment wall recess, and wherein said supporting structure being made out of an integral piece of material.

* * * * *